US007590363B2

(12) United States Patent
Yokoyama

(10) Patent No.: US 7,590,363 B2
(45) Date of Patent: Sep. 15, 2009

(54) IMAGE FORMING APPARATUS AND CONTROL METHOD

(75) Inventor: Seiji Yokoyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 338 days.

(21) Appl. No.: 11/567,542

(22) Filed: Dec. 6, 2006

(65) Prior Publication Data

US 2007/0134010 A1 Jun. 14, 2007

(30) Foreign Application Priority Data

Dec. 12, 2005 (JP) ..... 2005-358162

(51) Int. Cl.
*G03G 15/01* (2006.01)
*G03G 15/00* (2006.01)

(52) U.S. Cl. ..... 399/39; 399/49

(58) Field of Classification Search ..... 399/39, 399/49, 29, 72

See application file for complete search history.

(56) References Cited

U.S. PATENT DOCUMENTS 7,450,866 B2 * 11/2008 Sato ..... 399/49

FOREIGN PATENT DOCUMENTS

JP 05119578 A * 5/1993
JP 2003-084532 3/2003

* cited by examiner

*Primary Examiner*—Susan S Lee
(74) *Attorney, Agent, or Firm*—Fitzpatrick, Cella, Harper & Scinto

(57) ABSTRACT

This invention has an object to process color balance adjustment at high speed in an image forming apparatus without depending on different feeding speeds for different printing materials. To accomplish this, an image forming apparatus of the invention detects color balances while a printing material on which toner patches are formed is fed on a second feeding path. Since images are formed on different types of printing materials at different feeding speeds, the image forming apparatus of the invention processes color balance adjustment at high speed without depending on the feeding speed at the time of image formation by switching the feeding speed on the feeding path.

6 Claims, 19 Drawing Sheets

IMAGE FORMING APPARATUS AND CONTROL METHOD

BACKGROUND OF THE INVENTION

1. Field of the Invention

The present invention relates to an image forming apparatus such as a color printer or a color copying machine which improves color reproducibility and a control method therefor.

2. Description of the Related Art

Recently, electrophotographic image forming apparatuses and the like such as color printers and color copying machines have been required to improve image quality. If, however, components of an image forming apparatus vary in operation due to environmental changes or long use, the obtained images vary in density. An electrophotographic image forming apparatus, in particular, varies in density due to even slight environmental fluctuation, which may lead to a deterioration in color balance. For this reason, the image forming apparatus needs to include a means for keeping density and tone characteristics constant.

Japanese Patent Laid-Open No. 2003-084532 discloses a correction means for correcting process conditions such as exposure amount and developing bias and a lookup table (LUT) in accordance with temperature and humidity with respect to the toner of each color.

The correction means forms toner patches on a printing material by using toners of the respective colors so as to obtain constant density or tone characteristics even with variations in the components of the apparatus. The correction means then detects the density or chromaticity of each toner patch by using a sensor. Finally, the correction means performs density calibration control by applying feedback to process conditions such as exposure amount and developing bias in accordance with the detection result. This stabilizes the density or chromaticity of the formed image.

However, the following problems arise in the image forming apparatus disclosed in Japanese Patent Laid-Open No. 2003-084532. In general, when adjusting the color balances, the image forming apparatus preferably forms toner patches by using the same image formation conditions as those at the time of normal image formation. In addition, the image forming apparatus preferably detects toner patches at the same feeding speed as that at the time of normal image formation.

In general, however, the image forming apparatus changes the feeding speed of a printing material in accordance with the type of printing material (e.g., plain paper or thick paper). For example, the feeding speed of a printing material such as thick paper is set lower than that of plain paper. Color balance adjustment using a printing material with a low feeding speed requires more time than color balance adjustment using plain paper.

SUMMARY OF THE INVENTION

The present invention enables to provide an image forming apparatus which suppresses the prolongation of color balance adjustment even when applying different feeding speeds for different printing materials.

According to the present inventions the foregoing problem is solved by providing an image forming apparatus comprising:

a first feeding path adapted to feed a printing material;

an image forming unit adapted to form a toner patch on the printing material fed on the first feeding path;

a second feeding path adapted to reverse an front surface and back surface of the printing material fed from the first feeding path and return the reversed printing material to the first feeding path again;

a color balance detection unit placed on the second feeding path and adapted to detect a color balance of the toner patch formed on the printing material by the image forming unit; and a color balance adjusting unit adapted to adjust a color balance in the image forming unit based on the detected color balance.

According to another aspect of the present invention, the foregoing problem is solved by providing a control method for an image forming apparatus, comprising the steps of:

forming a toner patch on a printing material fed on a first feeding path included in the image forming apparatus;

detecting a color balance by using a color balance detection unit which is included in the image forming apparatus and detects a color balance of the toner patch formed on the printing material; and adjusting a color balance in image formation based on the detected color balance.

Further features of the present invention will become apparent from the following description of exemplary embodiments (with reference to the attached drawings).

DESCRIPTION OF THE EMBODIMENTS

Preferred embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

First Embodiment

Figure 1:
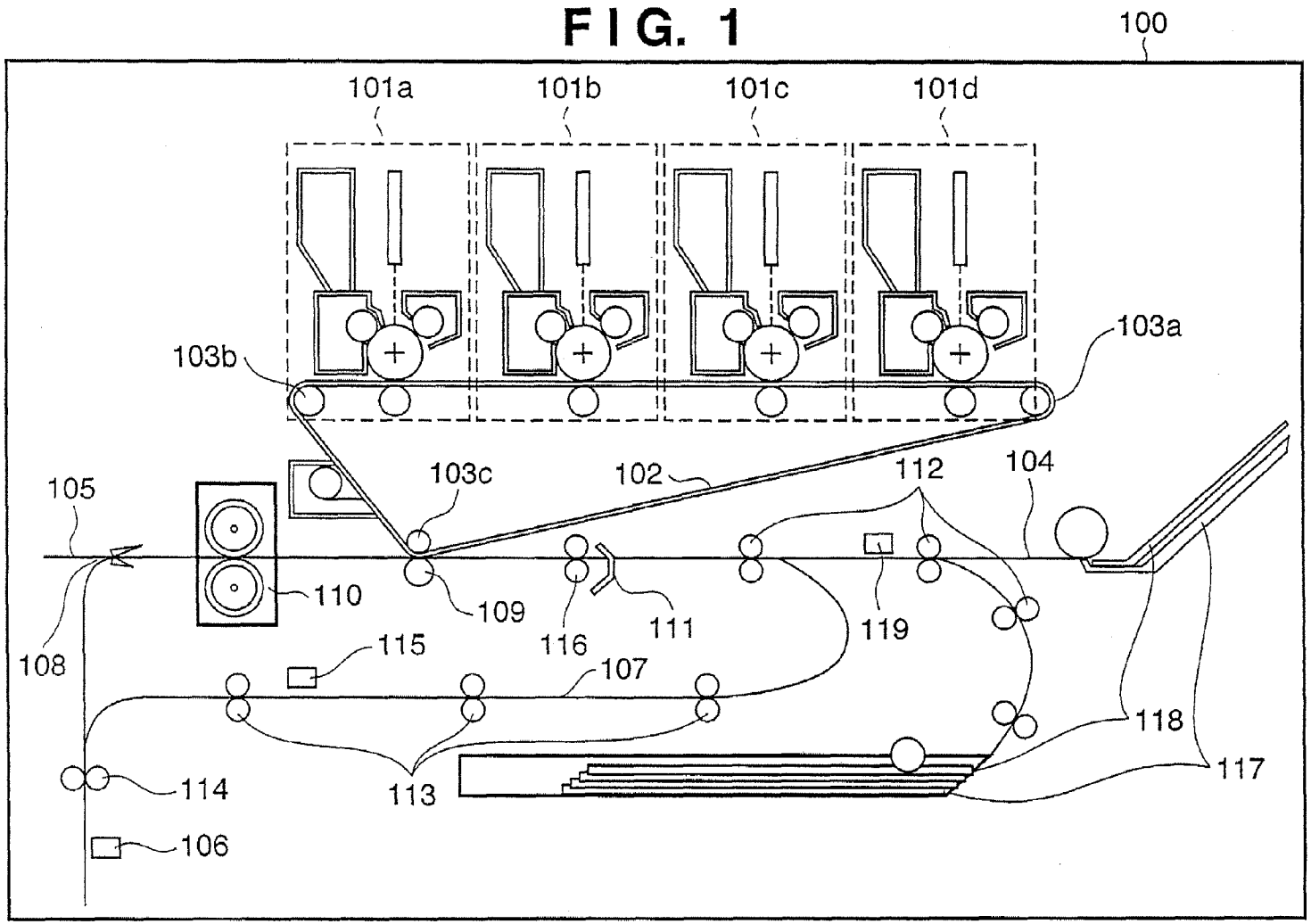
FIG. 1 is a view showing the overall arrangement of an image forming apparatus according to an embodiment.

FIG. 1 is a view showing the overall arrangement of an image forming apparatus according to the first embodiment. The embodiment exemplifies a laser beam printer as an image forming apparatus. However, the present invention is not limited to only a laser beam printer.

A laser beam printer 100 includes image forming units 101*a*, 101*b*, 101*c*, and 101*d* which form images (e.g., toner patches). Image forming units 101, i.e., 101*a* to 101*d*, are stations installed by the number of developing colors. Each station includes, for example, a photosensitive drum, charger, laser scanner, developing unit, toner cartridge, and primary transfer roller. Note that the image forming units 101 form electrostatic latent images on the surfaces of the photosensitive drums by exposure in accordance with image data for the respective colors. Thereafter, the laser beam printer 100 develops the electrostatic latent images into visible images, and records/fixes the resultant color visible image onto a printing material such as a recording medium.

The laser beam printer 100 includes an intermediate transfer belt 102, feeding rollers 112, secondary transfer roller 109, first feeding path 104, and fixing device 110. The intermediate transfer belt 102 is an endless belt tightly wound around a driving roller 103*a* and driven rollers 103*b* and 103*c*. Note that the intermediate transfer belt 102 comes into contact with the photosensitive drums to sequentially primarily transfer toner images. The first feeding path 104 is a feeding path extending from a paper feeding unit 117 to a discharge unit 105 through the secondary transfer roller 109 which forms an image on a printing material 118. The first feeding path 104 does not include the reversal feeding path described later.

The printing material 118 fed from the paper feeding unit 117 is fed to the first feeding path 104 and passes through a printing material thickness sensor 119, which detects the thickness of the printing material 118. The laser beam printer 100 adjusts the feeding speed for the feeding path at the time of image formation in accordance with the detected thickness of the printing material 118. This is because this operation optimizes transfer conditions and fixing conditions in accordance with the thickness of the printing material 118.

The printing material 118 reaches the position of a pre-registration sensor 111, is fed by a predetermined amount to reach registration rollers 116, and waits in a standby state. When the printing material 118 in the standby state is fed again, the printing material 118 is clamped/fed by the intermediate transfer belt 102 and the secondary transfer roller 109, thereby secondarily transferring the multi-transferred color toner images onto the intermediate transfer belt 102.

The secondary transfer roller 109 comes into contact with the intermediate transfer belt 102 during secondary transfer, but separates from the intermediate transfer belt 102 after the secondary transfer. Thereafter, the laser beam printer 100 fixes the toner image on the printing material 118 by using the fixing device 110 while feeding the printing material 118. The fixing device 110 comprises a fixing roller which heats the toner and a press roller for pressing the printing material 118 against the fixing roller. The printing material 118 on which the toner image is fixed is discharged to the discharge unit 105. The image forming operation is then terminated.

The laser beam printer 100 includes a double-sided flapper 108 and a second feeding path 107 to allow image formation on both sides of the printing material 118. The second feeding path 107 is a feeding path branching from the first feeding path 104 at the position of the double-sided flapper 108. The second feeding path 107 is a so-called reversal feeding path, which merges with the first feeding path 104 through reversal rollers 114 and dual feeding rollers 113 which are on both sides of the feeding path. The laser beam printer 100 includes a sheet detection sensor 106, a color balance sensor 115, the reversal rollers 114, and the dual feeding rollers 113 which are arranged on the second feeding path 107.

Note that the sheet detection sensor 106 detects the fed printing material 118 and may be placed on at least one of the first and second feeding paths. It is preferable to place the sheet detection sensor 106 placed on the first feeding path at the position where the second feeding path merges with the first feeding path. When forming patches on thick paper, it is necessary to increase the feeding speed when the thick paper is sufficiently drawn into the second feeding path. For this purpose, it is preferable to place the sheet detection sensor 106 on the second feeding path. When performing image formation on the back surface of the thick paper, it is necessary to decrease the feeding speed when the printing material returns from the second feeding path to the first feeding path. For this purpose, it is preferable to place the sheet detection sensor 106 at the position where the second feeding path merges with the first feeding path.

The color balance sensor 115 includes a density sensor and color sensor which detect the color balance (density and chromaticity) of the image formed on the fed printing material 118.

Figure 2:
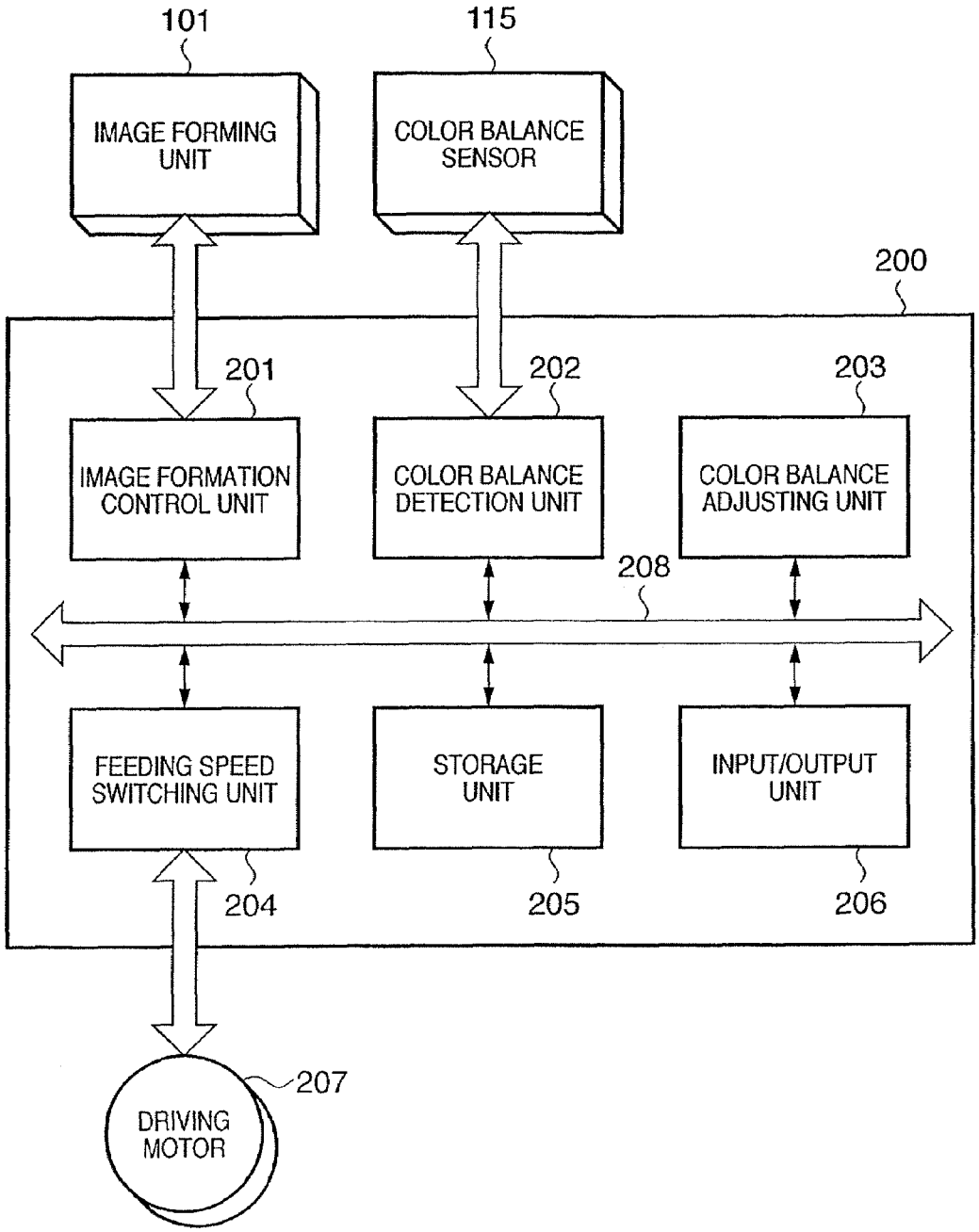
FIG. 2 is a block diagram showing the system control unit of the image forming apparatus according to the first embodiment.

FIG. 2 is a block diagram showing the system control unit of the image forming apparatus according to the first embodiment. FIG. 2 shows the main processing blocks in the first embodiment of the present invention.

A system control unit 200 includes an image formation control unit 201, color balance detection unit 202, color balance adjusting unit 203, feeding speed switching unit 204, storage unit 205, input/output unit 206, and interface 208. The system control unit 200 causes the image formation control unit 201 to form toner patches, and causes the color balance detection unit 202 to detect the color balance of each toner patch formed on the printing material 118.

The system control unit 200 causes the color balance adjusting unit 203 to apply feedback to process conditions such as the exposure amount and lookup table (LUT) in the image formation control unit 201 in accordance with the detected color balances. With this operation, the system control unit 200 adjusts the color balance of the image fixed on the printing material.

The feeding speed switching unit 204 adjusts the feeding speed of the printing material 118 fed on the first feeding path and the second feeding path. The feeding speed of a printing material is closely related to the image formation speed (process speed). According to this embodiment, the feeding speed includes at least first and second speeds. The first speed is the feeding speed set when an image is to be formed on a printing material such as thick paper. The second speed is the feeding speed set when an image is to be formed on a printing material such as plain paper. Note that the second speed is higher than the first speed. The first speed will be referred to as half speed, and the second speed will be referred to as normal speed.

The storage unit 205 may store color balance adjustment values corresponding to detected color balances. The storage unit 205 preferably stores feeding speeds suitable for the respective types of printing materials 118. The input/output unit 206 includes a user interface. The user can issue an instruction to execute color balance adjustment through the user interface. The input/output unit 206 may input information representing the type of printing material 118 used for color balance adjustment. In this case, the feeding speed switching unit 204 preferably adjusts the feeding speed of the printing material 118 in accordance with the input type of printing material 118.

Figure 3A:
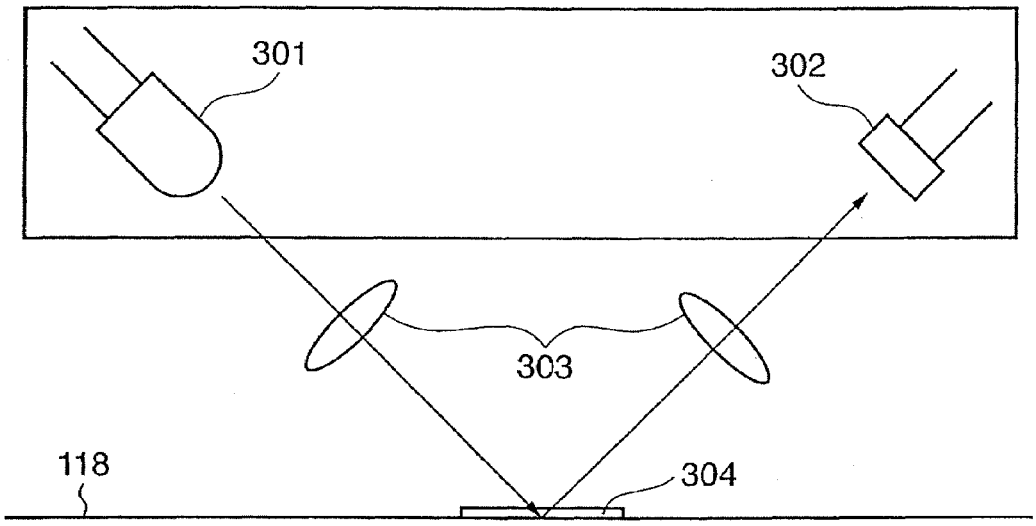
FIGS. 3A and 3B are views showing an example of the arrangement of a density sensor in a color balance sensor according to the first embodiment.
Figure 3B:
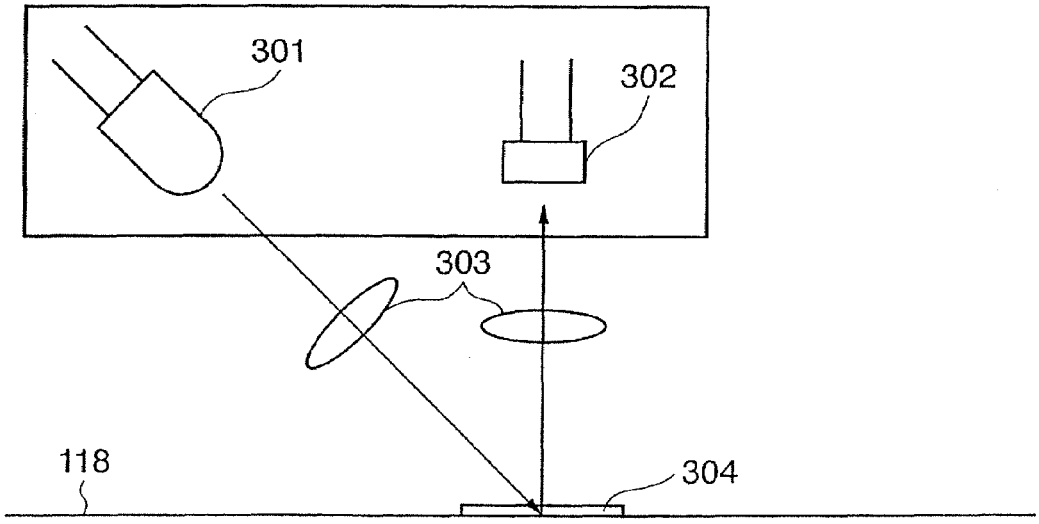

FIGS. 3A and 3B are views showing the arrangement of a density sensor as an example of the color balance sensor according to the first embodiment. According to the embodiment, the color balance detection unit 202 detects a color density by using a density sensor. The color balance adjusting unit 203 adjusts the density of an image to be formed by using the density detection result. The density sensor includes a light-emitting element 301 such as an LED and a light-receiving element 302 such as a photodiode or Cds. FIG. 3A shows an arrangement for detecting both a specular reflection component and a diffused reflection component. FIG. 3B shows an arrangement for detecting only a diffused reflection component without the influences of specular reflection.

The image forming apparatus often executes density calibration control independently of color balance adjustment. In general, a density sensor for density calibration control needs to be placed at a position to face the intermediate transfer belt 102 or the photosensitive drum. The density sensor detects a toner patch 304 formed on the intermediate transfer belt 102 or the photosensitive drum. However, density calibration control cannot control a change in the color balance of the image due to subsequent formation and fixing on the printing material.

For this reason, according to this embodiment, the color balance sensor 115 having the density sensor, color sensor, and the like is placed on the second feeding path 107 to detect the density of the monochrome toner image or the chromaticity of the full-color image which is fixed on the printing material.

As described above, the color balance sensor 115 includes a color sensor for detecting a chromaticity. The color sensor can use the same arrangement as that of the density sensor in FIGS. 3A and 3B. The color sensor uses, as the light-emitting element 301, light sources having different emission spectra which independently emit red light, green light, and blue light. The light-receiving element 302 need not be changed. Alternatively, the color sensor may use a light source which emits white light as the light-emitting element 301, and use three light-receiving elements having different spectral transparencies for red light, green light, and blue light on the light-receiving element 302.

Figure 4:
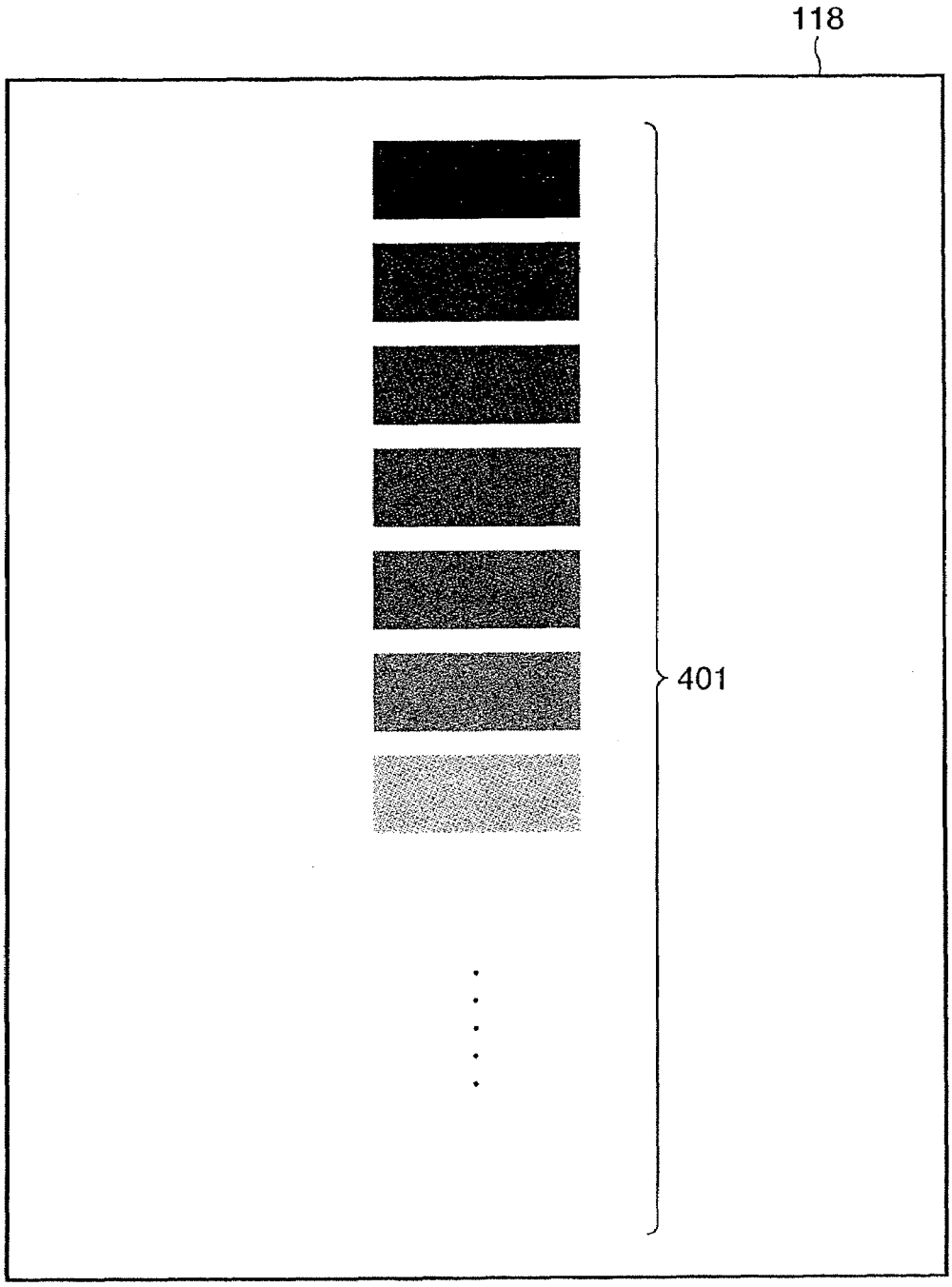
FIG. 4 is a view showing an example of a toner patch pattern formed on a printing material in the first embodiment.

FIG. 4 shows an example of the toner patch pattern formed on a printing material according to the first embodiment. A toner patch pattern 401 is obtained by consecutively forming monochrome or color mixture toner patches of cyan (C), magenta (M), yellow (Y), and black (K) on the printing material 118 while changing the density or chromaticity of each patch. The laser beam printer 100 detects the color balance of each toner patch by using the color balance sensor 115, thereby performing color balance adjustment.

FIGS. 5A to 5F are views for explaining feeding control for a printing material when double-sided image formation is to be performed according to the first embodiment. The embodiment is characterized by performing color balance adjustment on the second feeding path which feeds the printing material 118 while reversing its front and back surfaces at the time of double-sided image formation.

Figure 5A:
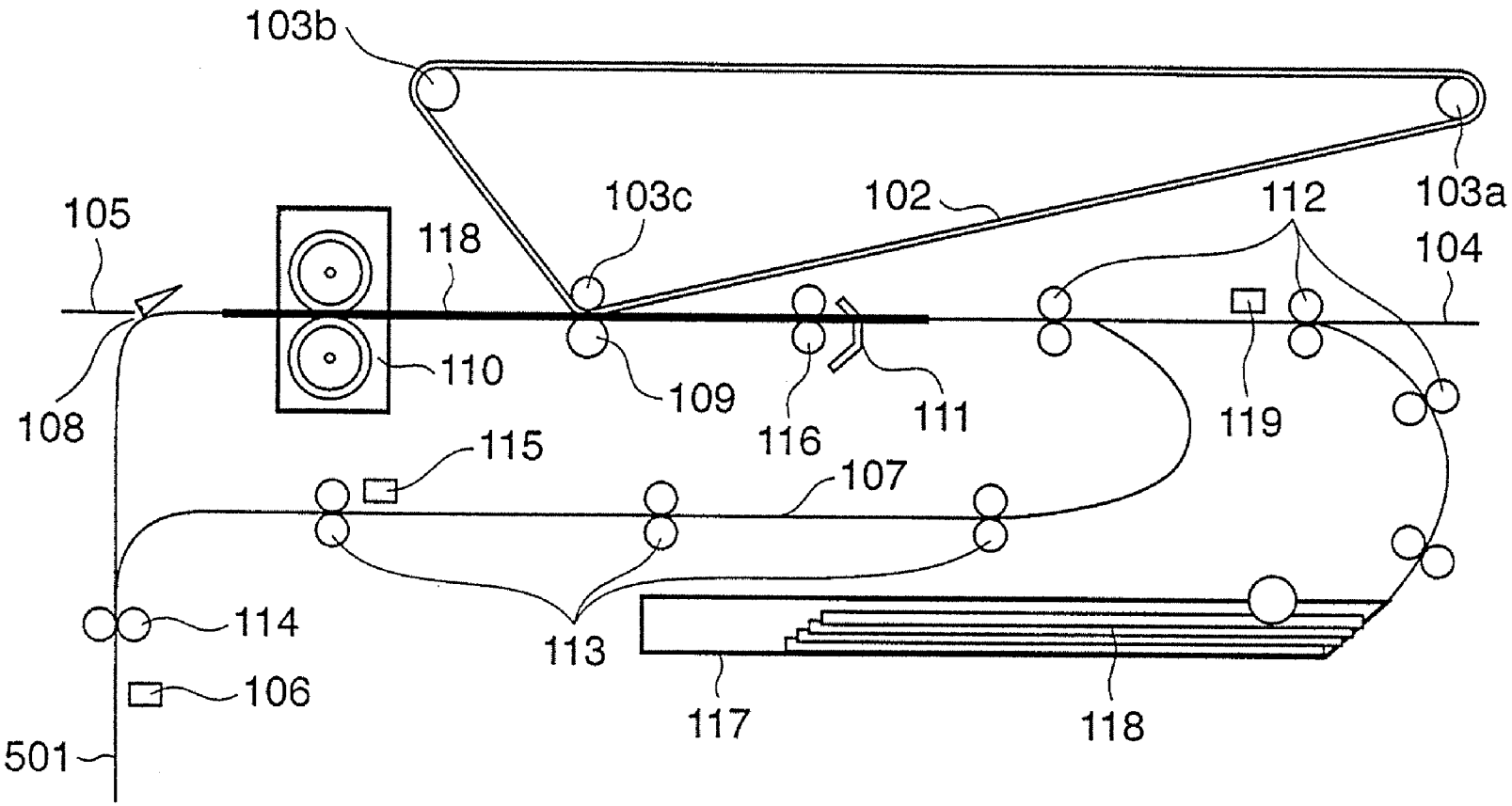
FIGS. 5A to 5F are views for explaining printing material feeding control in double-sided image formation according to the first embodiment.

Referring to FIG. 5A, the laser beam printer 100 feeds the printing material 118 from the paper feeding unit 117, and detects the thickness of the printing material 118 by using the printing material thickness sensor 119. The laser beam printer 100 causes the feeding speed switching unit 204 to adjust the feeding speed of the feeding rollers 112, registration rollers 116, and secondary transfer roller 109 in accordance with the detected thickness of the printing material 118.

When using thick paper as the printing material 118, in order to perform image formation at a feeding speed half that for plain paper, the feeding speed switching unit 204 sets the feeding speed on the first feeding path to a feeding speed half (half speed) that for plain paper (normal speed). Upon adjusting the feeding speed, the laser beam printer 100 forms a toner image on the surface of the printing material 118 by using the secondary transfer roller 109, and fuses/fixes the toner image by using the fixing device 110.

Figure 5B:
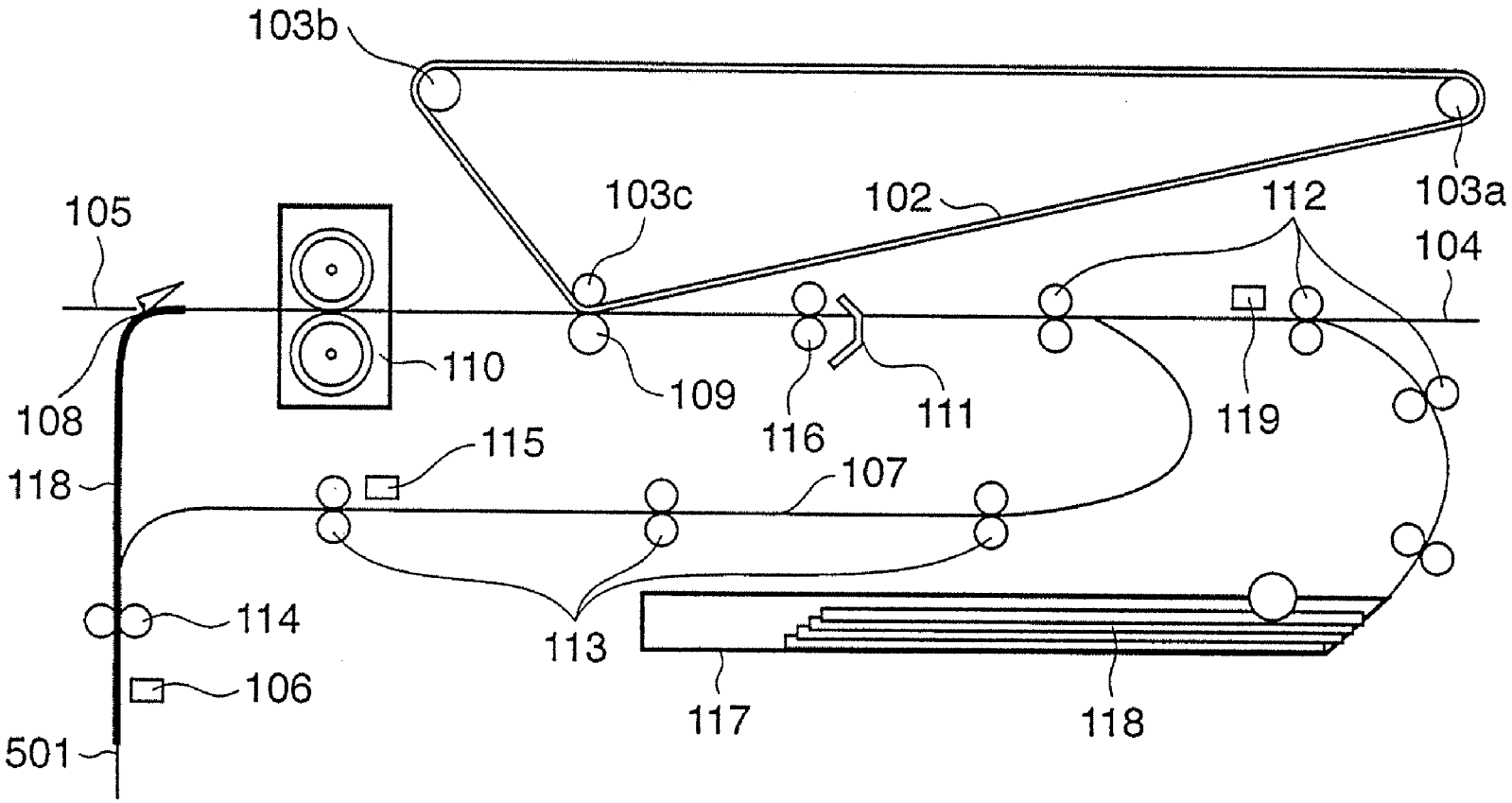
Figure 5C:
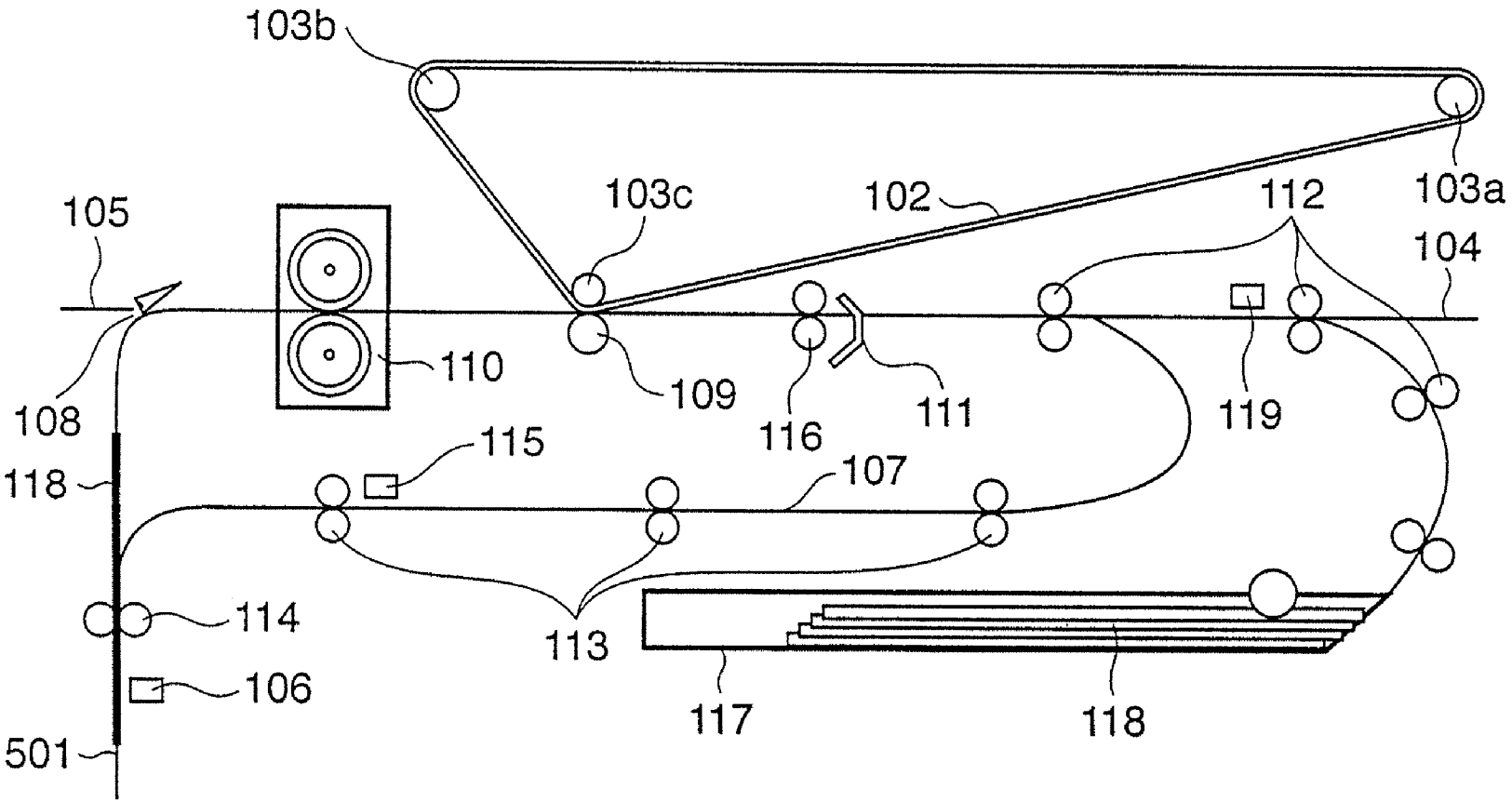

Referring to FIG. 5B, the double-sided flapper 108 reverses the front and back surfaces of the printing material 118 and feeds it to the second feeding path 107 (double-sided feeding path). Referring to FIG. 5C, the feeding speed switching unit 204 changes the rotational direction of the reversal rollers 114 when the printing material 118 has reached a reversal position 501. Note that the feeding speed switching unit 204 preferably detects, by using the sheet detection sensor 106, that the printing material 118 has reached the reversal position.

Figure 5D:
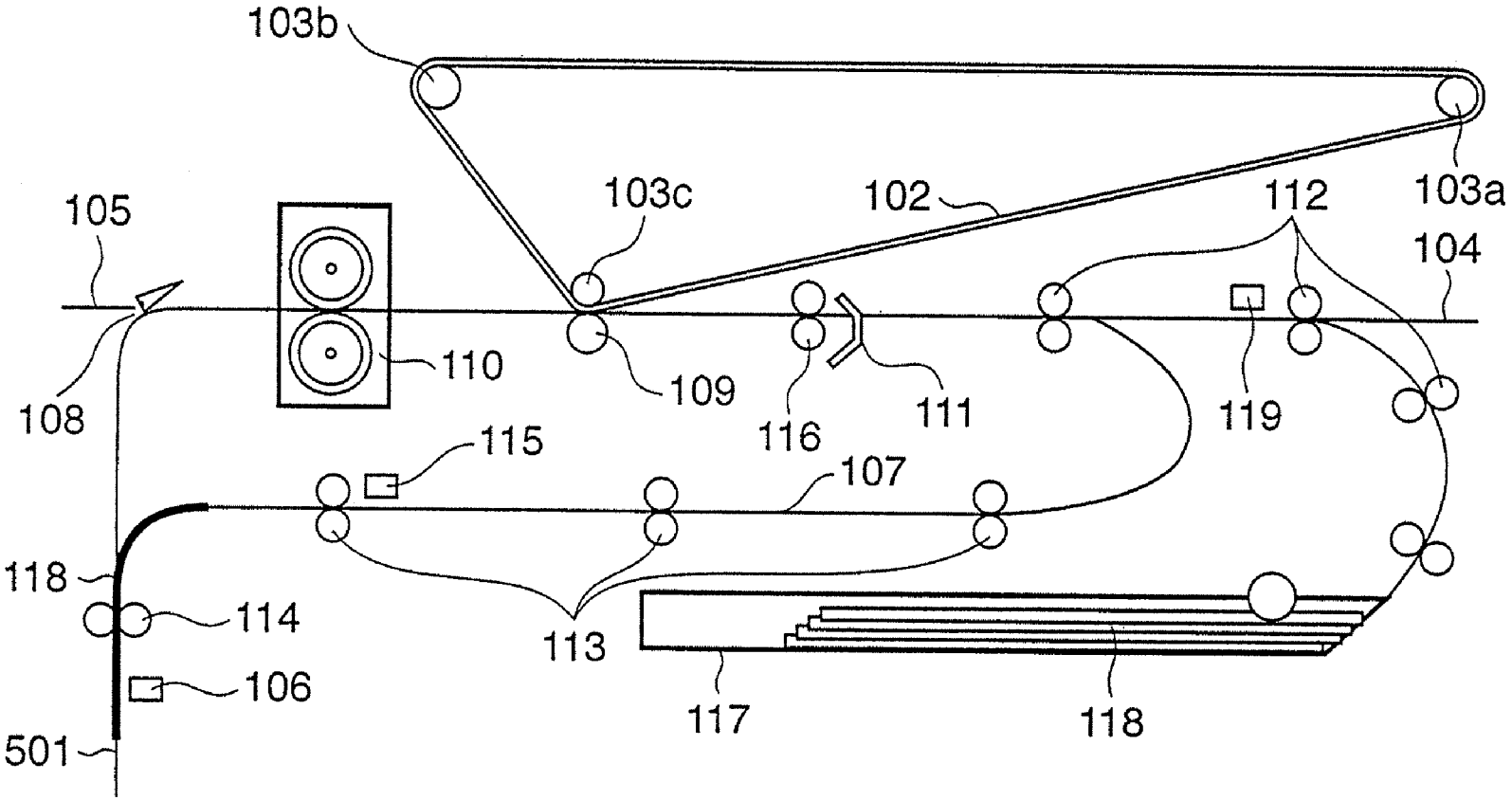

Referring to FIG. 5D, the dual feeding rollers 113 feed the printing material 118 on the second feeding path 107. According to this embodiment, the color balance detection unit 202 detects the color balance of the toner patch formed on the printing material 118 by using the color balance sensor 115.

Figure 5E:
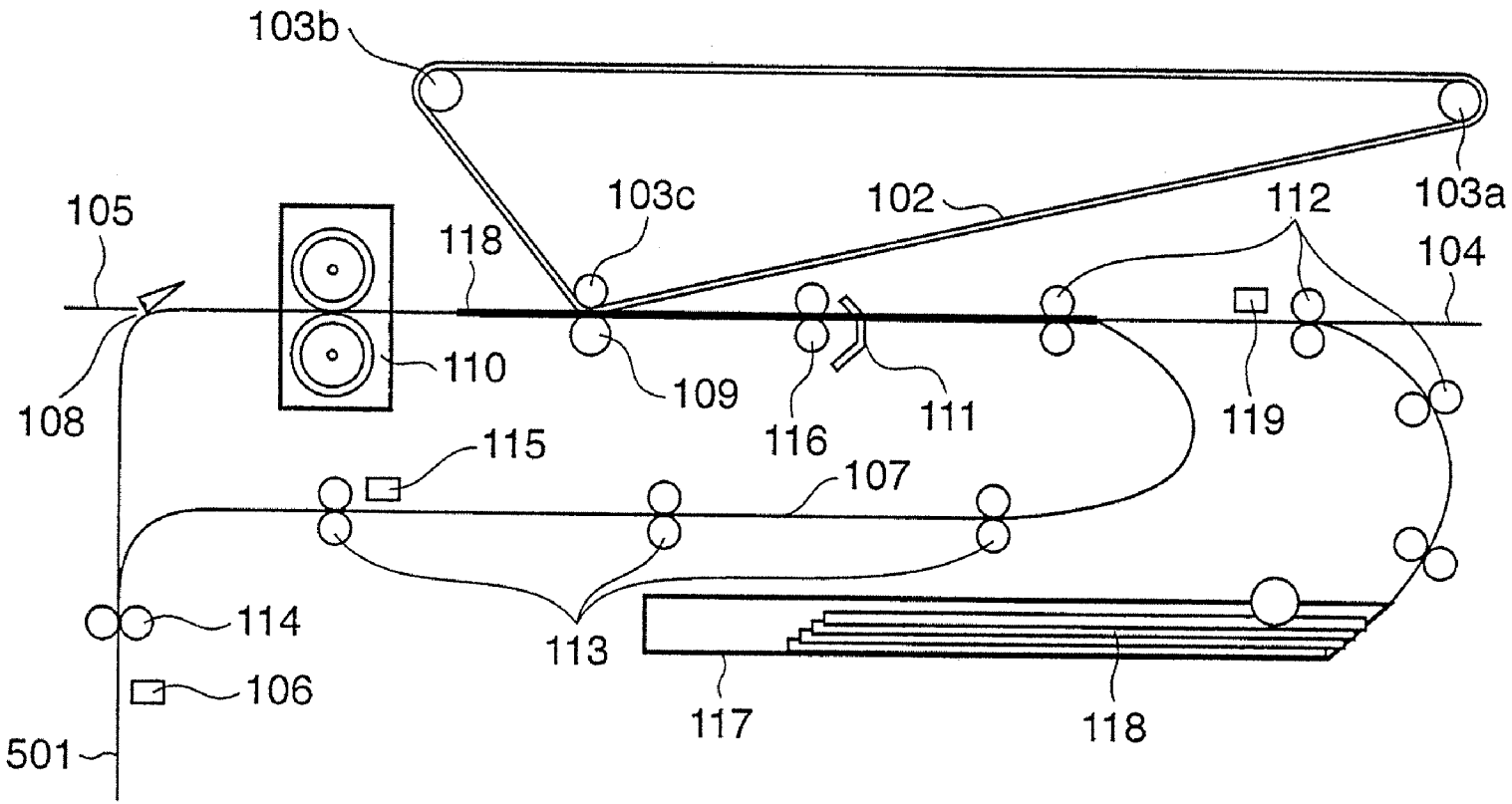
Figure 5F:
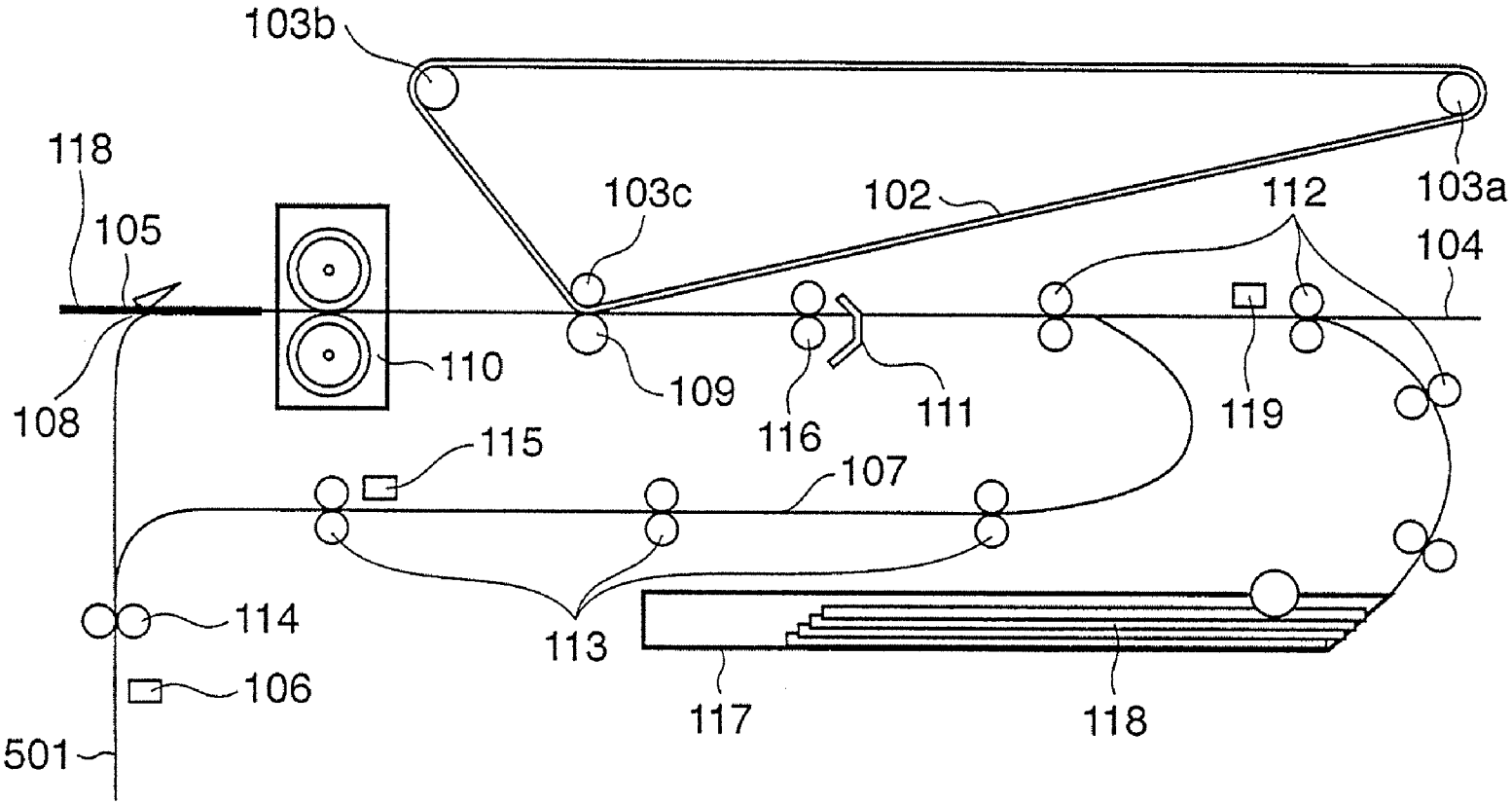

Referring to FIG. 5E, the printing material 118 is fed from the second feeding path 107 to the first feeding path 104 in a reversed state. The image formation control unit 201 causes the secondary transfer roller 109 to transfer the toner image onto the front surface of the printing material 118 fed on the first feeding path 104. In this case, the image formation control unit 201 may form toner patches for color balance adjustment on the printing material 118 by the first image formation, and may form color-balanced toner patches by the second image formation. Referring to FIG. 5F, the system control unit 200 terminates the double-sided image formation by discharging the printing material 118 onto the discharge unit 105 by using the double-sided flapper 108.

In the laser beam printer 100 in FIG. 1, the color balance sensor 115 is placed on the second feeding path 107, and the detection unit faces the image formation surface on the printing material 118. The color balance sensor 115 detects a chromaticity or density from each patch fixed on the printing material 118. The color balance detection unit 202 obtains an RGB output value or density value by using detected a chromaticity or density.

The user issues an instruction to start color balance adjustment through the input/output unit 206, and executes the adjustment. Alternatively, upon detecting an environmental fluctuation or the like, this embodiment may automatically execute color balance adjustment at a predetermined timing such as a timing corresponding to a predetermined number of image-formed sheets after color balance adjustment. In addition, the image forming apparatus of this embodiment changes the feeding speed at the time of image formation in accordance with the thickness of the printing material 118.

FIGS. 6A to 6E are views showing printing material feeding processing at the time of color balance adjustment when thick paper is used according to the first embodiment. The following assumes that the user selects thick paper as the printing material 118 to be used for color balance adjustment.

Figure 6A:
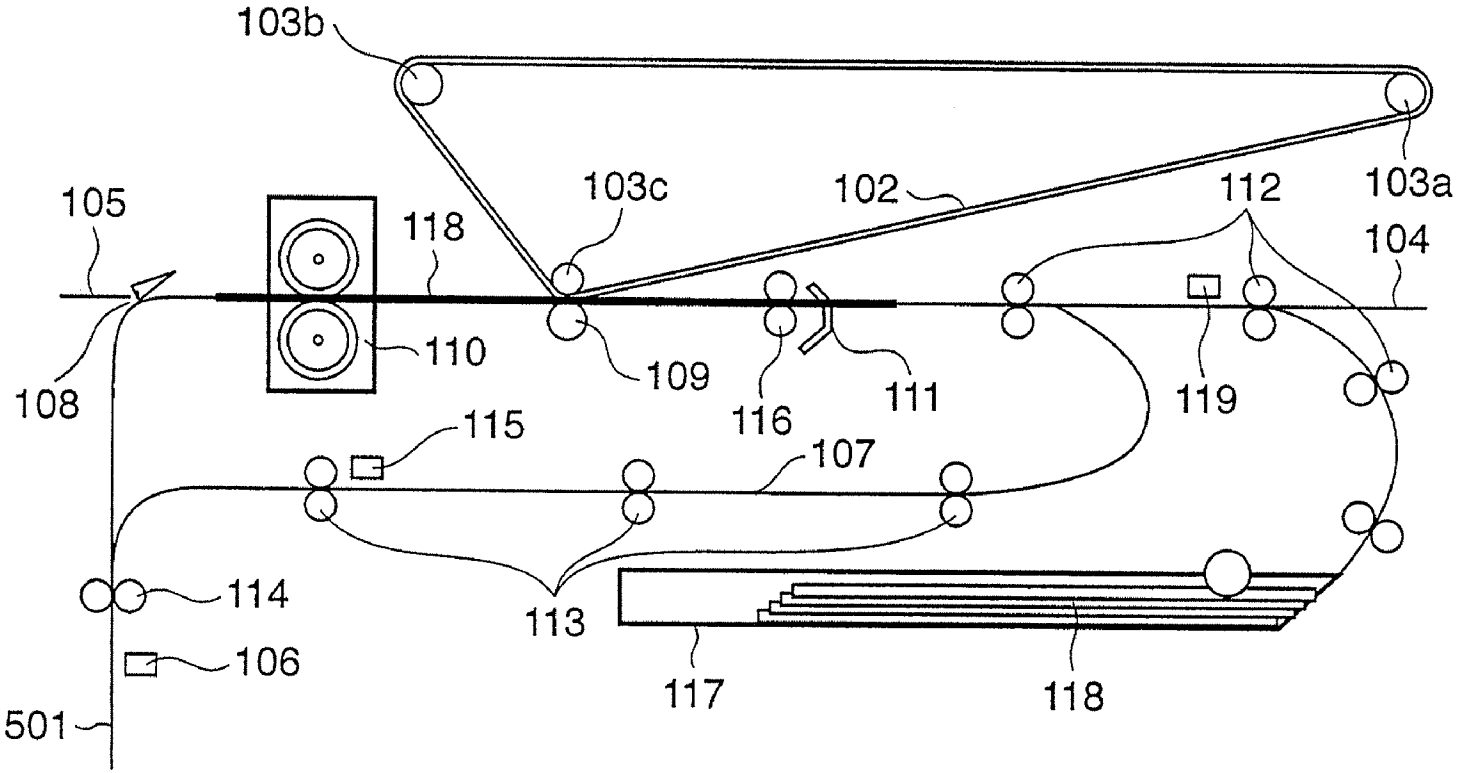
FIGS. 6A to 6E are views showing feeding operation at the time of color balance adjustment when thick paper is used according to the first embodiment.
Figure 6B:
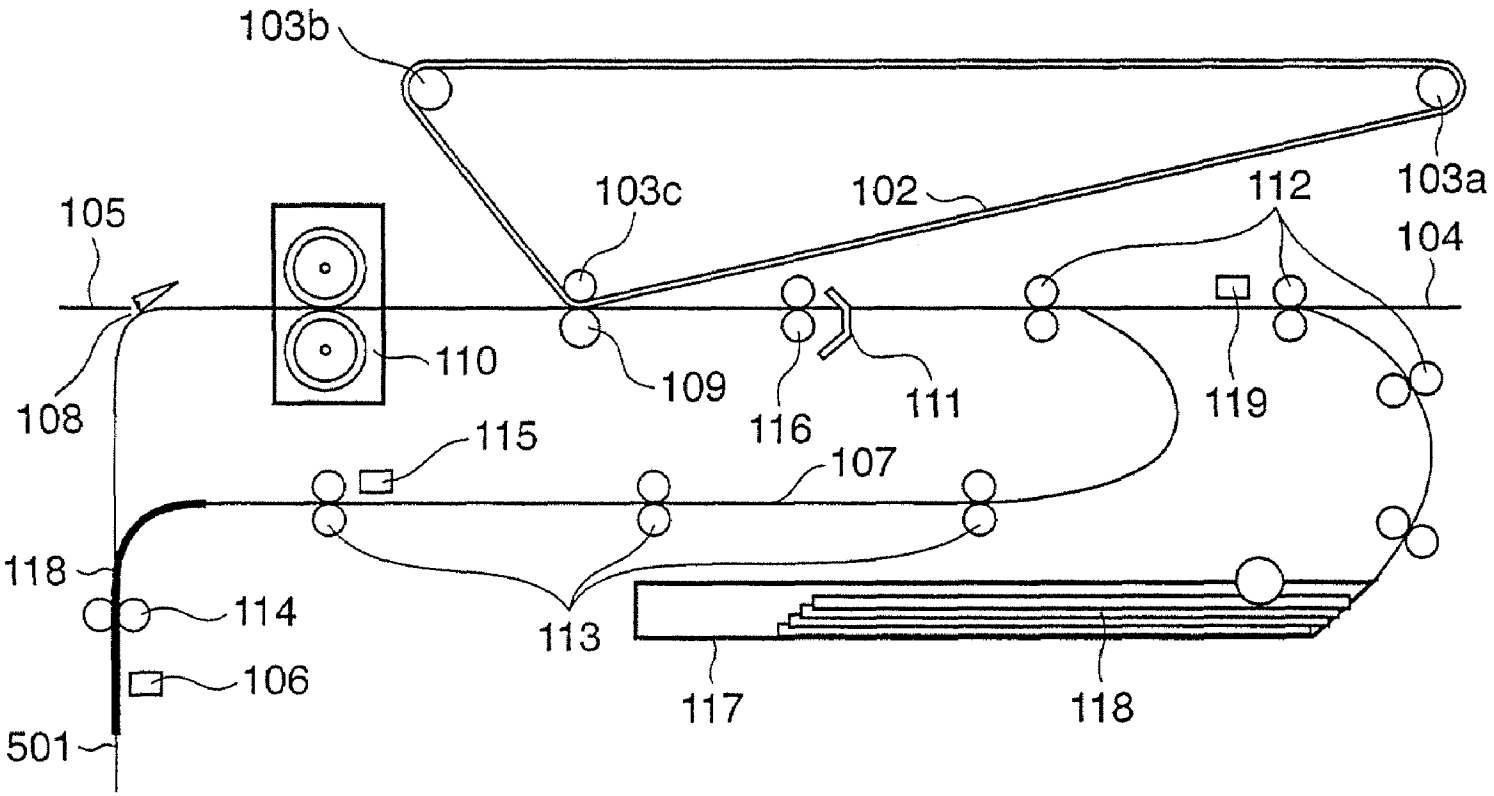

Referring to FIG. 6A, the system control unit 200 causes the printing material thickness sensor 119 to detect the thickness of the printing material 118, and starts image formation at half speed upon determining that thick paper has been fed. Referring to FIG. 6B, the printing material 118 on which the toner patch image is formed passes through a fixing device 13 and is fed by the double-sided flapper 108 and the reversal rollers 114 in the manner shown in FIG. 6B. In addition, the feeding speed switching unit 204 reverses the rotational direction of the reversal rollers 114, and switches the feeding speed of the reversal rollers 114 and double-sided feeding rollers 113 to normal speed, thereby drawing the thick paper into the second feeding path 107. At the same time, the feeding speed switching unit 204 switches the feeding speed of the feeding rollers 112, registration rollers 116, secondary transfer roller 109, and the like arranged on the first feeding path 104 to normal speed.

Figure 6C:
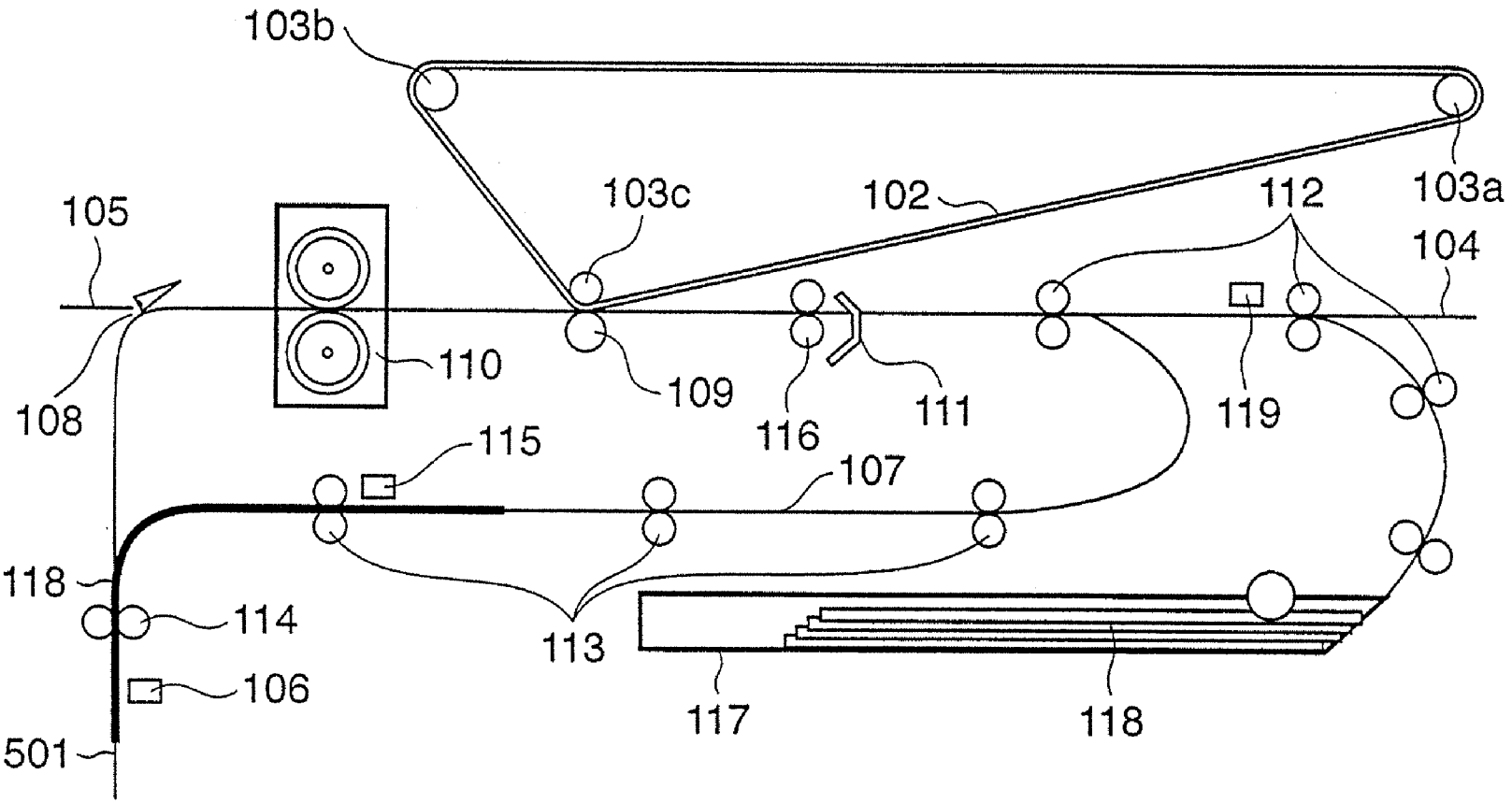

Referring to FIG. 6C, the color balance detection unit 202 detects the color balance of each toner patch formed on the thick paper fed at normal speed by using the color balance sensor 115. This speeds up the color balance adjustment without dependence on the feeding speed corresponding to the thickness of the printing material 118 at the time of image formation. Note that the color balance adjusting unit 203 transfers an adjustment value for the color balance to the image formation control unit 201 in accordance with the color balance detected by the color balance sensor 115.

Figure 6D:
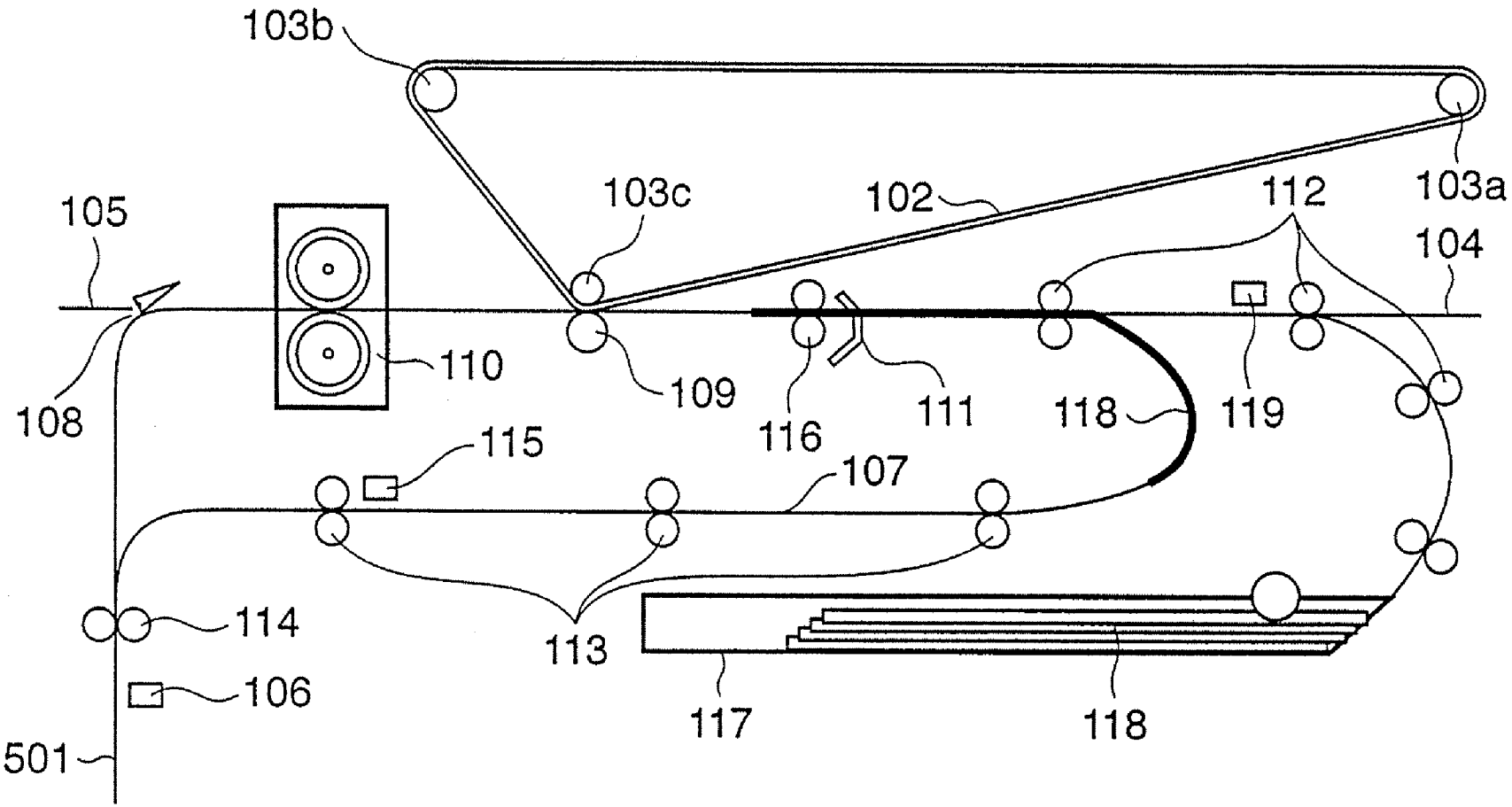

Referring to FIG. 6D, the printing material 118 is fed again to the first feeding path 104. In this case, a sensor for detecting that the printing material 118 has been fed to the first feeding path 104 may be placed on the first feeding path 104. With this sheet detection sensor, when the printing material 118 is fed from the second feeding path to the first feeding path, the feeding speed switching unit 204 can switch the feeding speed, which has been switched to normal speed for the formation of an image on the back surface, to half speed again. In addition, the feeding speed switching unit 204 may switch the feeding speed at the end of the color balance detection.

Figure 6E:
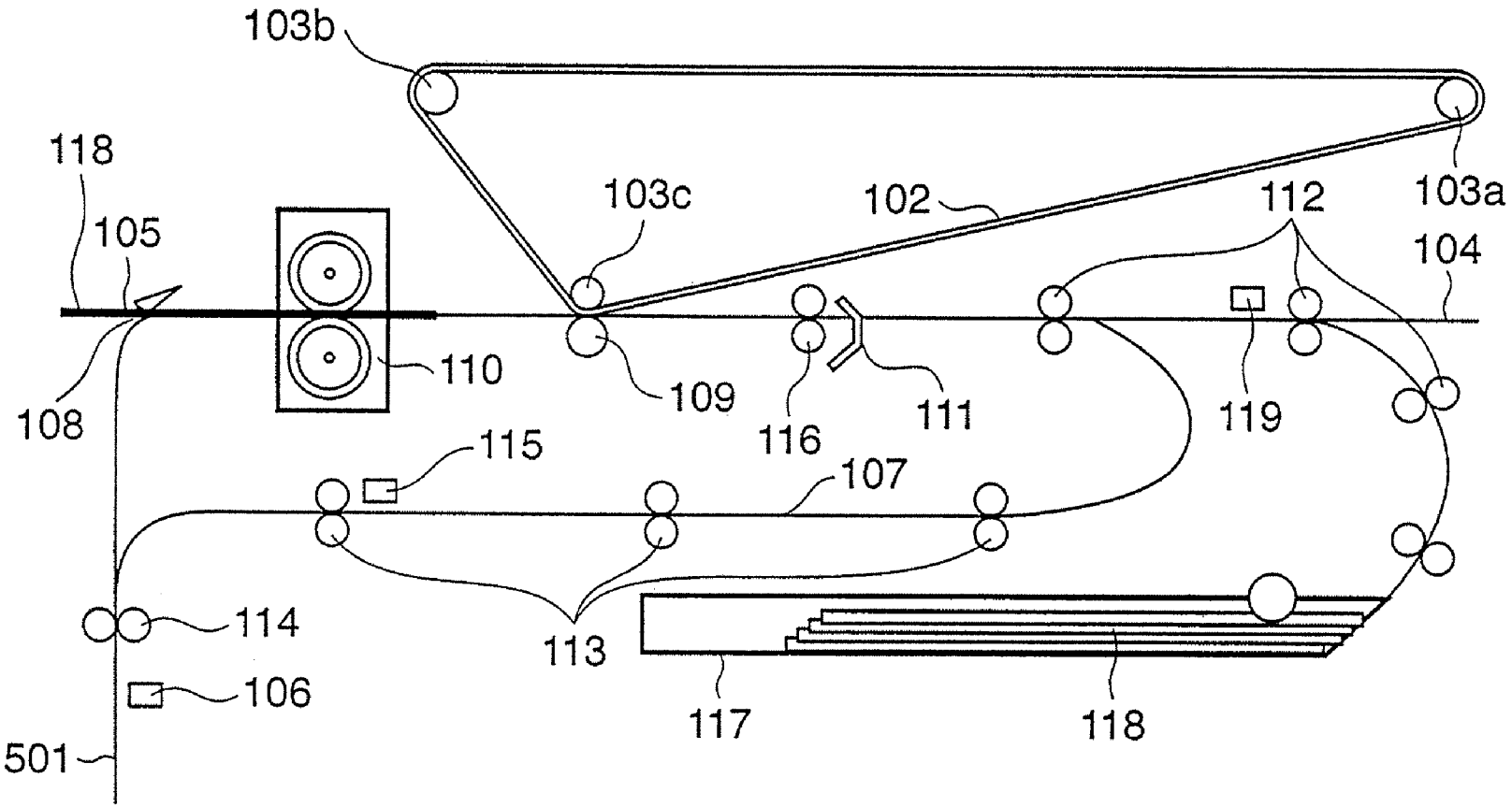

Referring to FIG. 6E, the laser beam printer 100 forms an image on the printing material 118 which is reversed and fed, and delivers the printing material 118 to the discharge unit 105. Note that the laser beam printer 100 may form, on the reversed printing material 118, a toner patch based on the color balance value adjusted by color balance adjustment.

Figure 7:
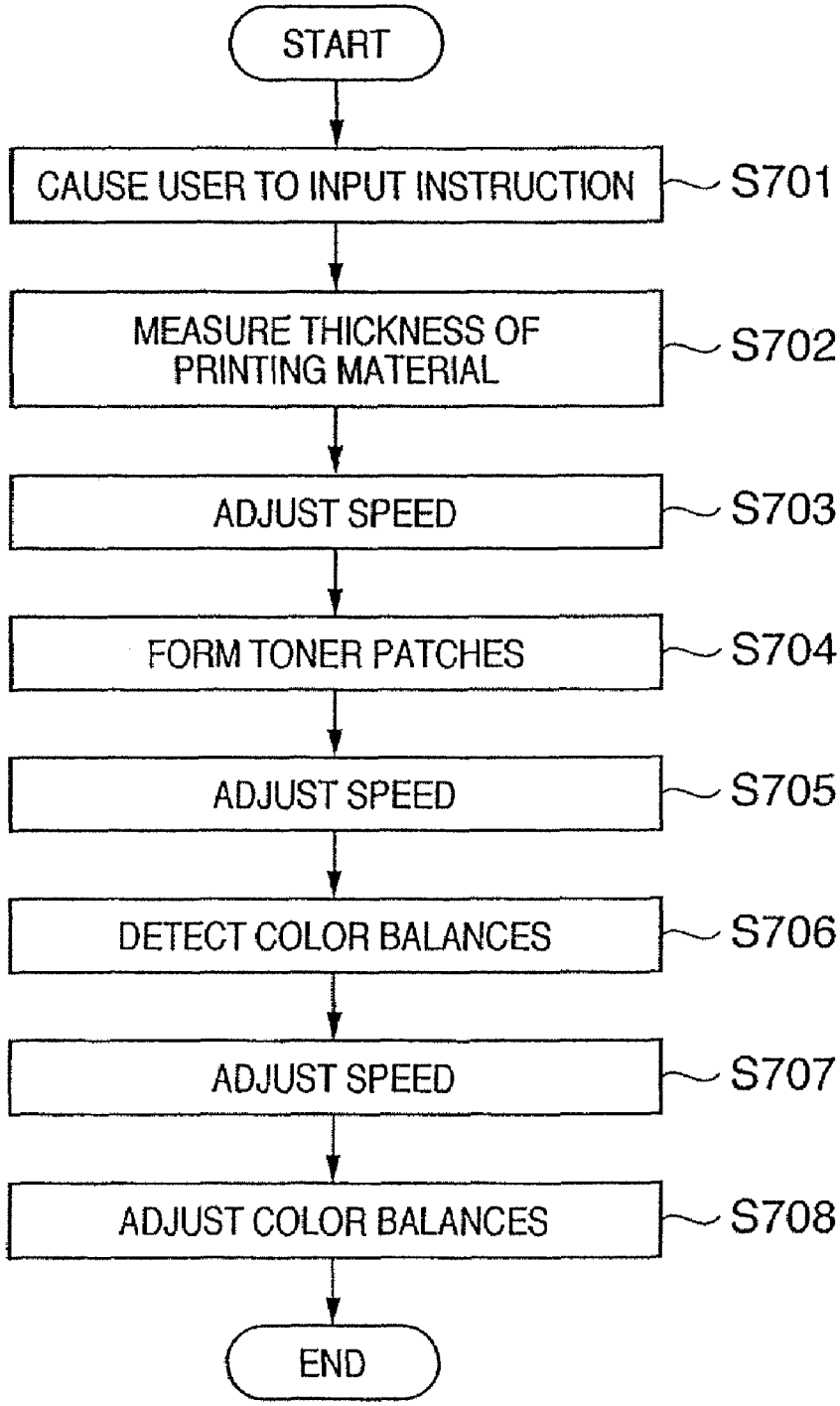
FIG. 7 is a flowchart showing processing in color balance adjustment in the first embodiment.

FIG. 7 is a flowchart showing color balance adjustment processing in the first embodiment. Control for the formation of a toner patch on the fed printing material 118 and color balance adjustment at normal speed will be described next.

In step S701, the system control unit 200 starts adjusting the color balance upon detecting an instruction to start adjustment from the user by using the input/output unit 206. As described above, this embodiment may automatically start color balance adjustment upon detection of an environmental fluctuation or after images are formed on a predetermined number of sheets after the preceding color balance adjustment.

In step S702, the feeding speed switching unit 204 specifies the thickness of the printing material 118 input from the printing material thickness sensor 119. In this case, the feeding speed switching unit 204 obtains the thickness of the printing material 118 by comparing the above input measurement value with the measurement value of the printing material thickness sensor 119 which is stored in advance when the printing material 118 is not fed.

In step S703, the feeding speed switching unit 204 adjusts the driving speeds of the respective rollers on the first feeding path 104 and the second feeding path 107 in accordance with the measured thickness of the printing material 118. More specifically, the feeding speed switching unit 204 transfers an instruction to adjust the rotational speed to the driving motor connected to each roller. This adjustment makes it possible to set a proper feeding speed in accordance with the thickness of the printing material 118 when forming an image on the printing material 118.

In step S704, the image formation control unit 201 transfers, to the image forming unit 101, an instruction to form a toner patch based on the current color balance adjustment value. The image forming unit 101 forms an image on the fed printing material 118 in accordance with this instruction. Thereafter, the printing material 118 passes through the fixing device 110, and is fed to the second feeding path 107 via the double-sided flapper 108.

In step S705, the feeding speed switching unit 204 switches the feeding speed to normal speed when the current feeding speed is adjusted in accordance with the thickness of the printing material 118 at the time of detection of the printing material 118 by the sheet detection sensor 106. In step S706, the color balance detection unit 202 detects the color balance of the toner patch formed on the printing material 118 by using the color balance sensor 115.

In step S707, the feeding speed switching unit 204 returns the feeding speed to the original speed when the feeding speed has been switched in step S705 after the detection of the color balance. In step S708, the color balance adjusting unit 203 transfers the color balance adjustment values to the image formation control unit 201 based on the detected color balances, and terminates the color balance adjustment.

As described above, the image forming apparatus according to this embodiment adjusts the color balance by detecting the color balance of each toner patch formed on a printing material on the second feeding path. Therefore, the present invention can set different feeding speeds at the time of image formation and at the time of color balance detection. This allows the image forming apparatus of the present invention to set a higher feeding speed at the time of color balance detection than at the time of image formation. This makes it possible to speed up color balance detection.

The present invention allows for various modifications to the above embodiment. For example, the image forming apparatus may include a feeding speed switching unit which switches the respective feeding speeds on the first and second feeding paths from the first speed to the second speed at least while color balances are detected. With this arrangement, even if a printing material is thicker than plain paper and the first speed is adjusted (decreased) to a proper speed, switching the feeding speed to the second speed at the time of color balance detection makes it possible to speed up color balance detection.

In addition, the feeding speed switching unit in the present invention may switch the feeding speed from the second speed to the first speed upon completion of color balance detection. This allows the image forming apparatus to form an image at a proper feeding speed even when printing on the back surface in double-sided printing operation.

Furthermore, the feeding speed switching unit in the present invention may adjust the feeding speed on the first feeding path in accordance with the type of printing material. This allows the image forming apparatus to perform image formation at a feeding speed suitable for the type of printing material. Therefore, the image forming apparatus need not switch the feeding speed fox all types of printing materials at the time of color balance detection, and may switch the feeding speed only for a printing material whose feeding speed is decreased at the time of image formation. This makes it possible to simplify the processing.

Second Embodiment

The present invention forms toner patches with various color balances on a printing material 118, and actually measures the color balances by using a color balance sensor 115, thereby obtaining the differences between the measured color balances and desired color balances. Thereafter, according to the present invention, a color balance adjusting unit 203 needs to apply feedback to process conditions. In this method, the feeding speed of the printing material 118 and the measurement time by the color balance sensor 115 per toner patch limits the number of toner patches which can be formed on the printing material 118. If, therefore, the size of the printing material 118 is small with respect to the number of toner patches required for the calculation of color balances, an image forming unit 101 needs to form a toner patch pattern in sets of two or three patches on the printing material 118.

If color balance adjustment requires two printing materials 118, the image forming apparatus needs to form two toner patches. For this reason, as in the first embodiment, the image forming apparatus cannot switch the overall feeding speed of the image forming apparatus when the first printing material 118 reaches a second feeding path 107. Switching the overall feeding speed of the image forming apparatus may make it impossible to form an image at a feeding speed suitable for the second or subsequent printing material 118. This embodiment is characterized by shortening the time required for color balance adjustment by switching only the feeding speed on the second feeding path 107 to the second speed even if color balance adjustment requires a plurality of printing materials 118.

Figure 8A:
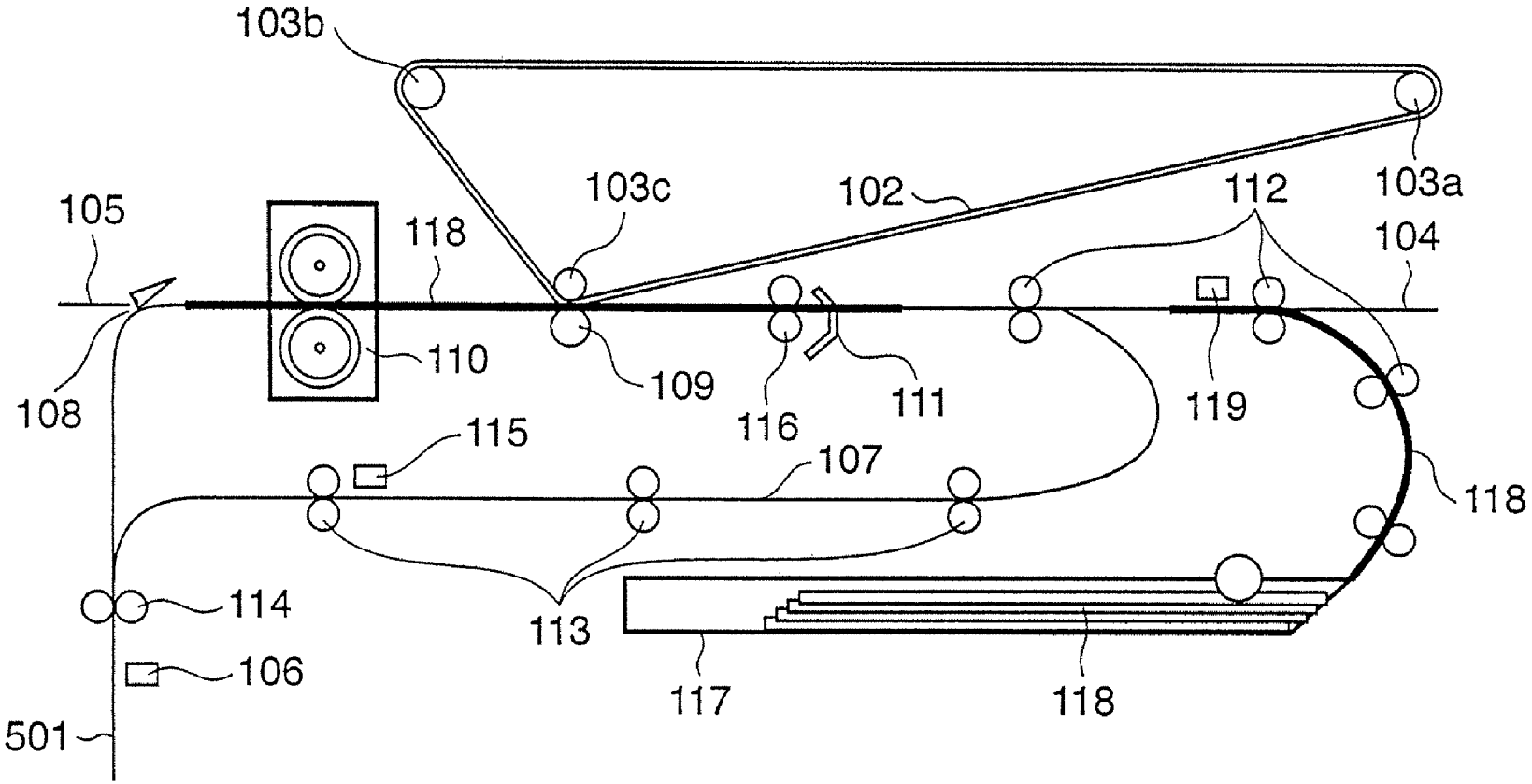
FIGS. 8A and 8B are views showing a printing material feeding method at the time of color balance adjustment when two thick paper sheets are used in the second embodiment.
Figure 8B:
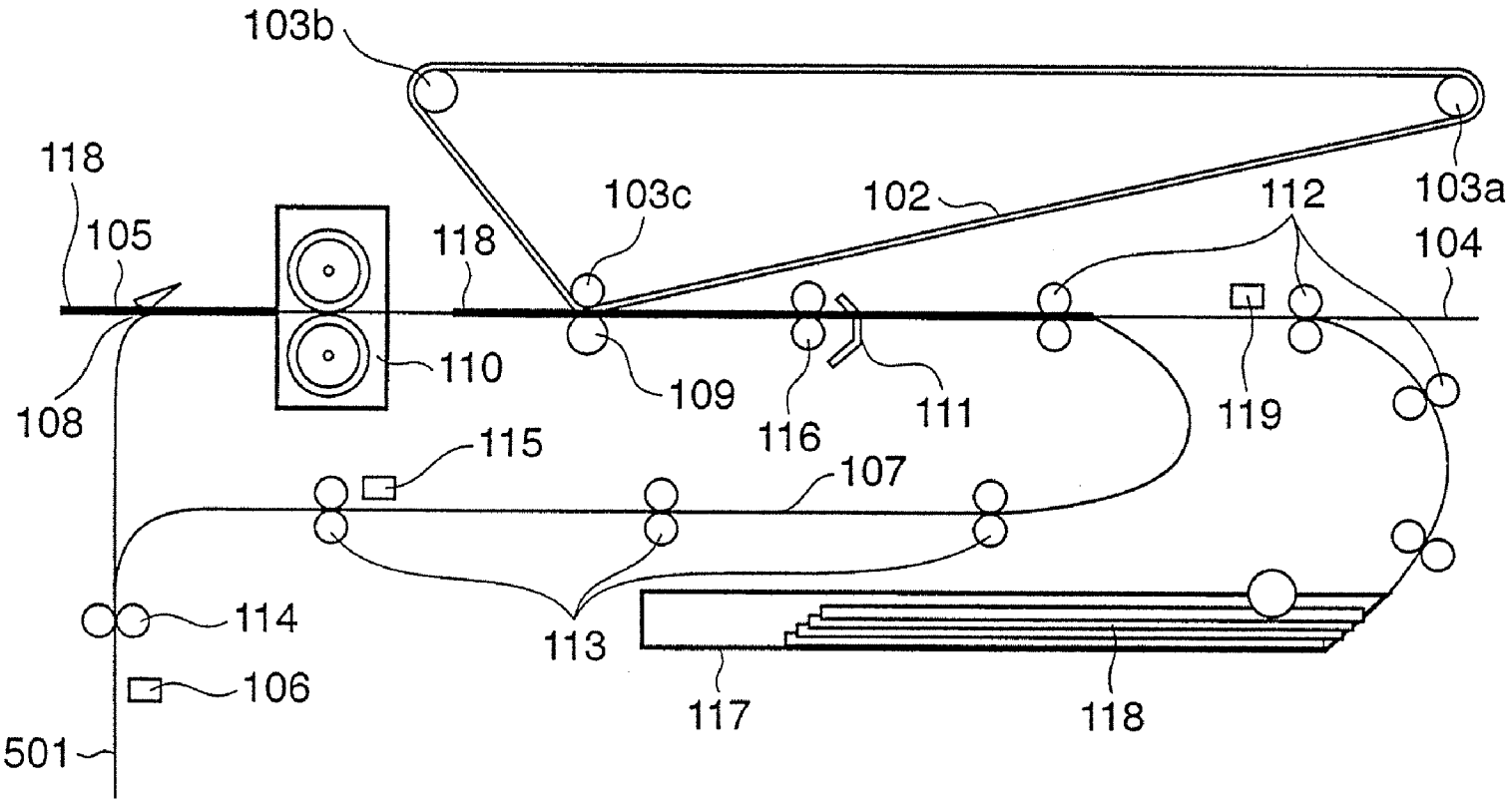

FIGS. 8A and 8B are views showing a printing material feeding method at the time of color balance adjustment when two thick paper sheets are used in the second embodiment. Note that the states of the first printing material 118 at the positions in FIGS. 6A to 6D are the same as those in this embodiment, and hence illustrations thereof will be omitted. The differences between the states of the printing material 118 at the positions in FIGS. 6A to 6D and those in this embodiment will be described. Note that the sequence of operation corresponds to FIGS. 6A, 6B, 6C, 6D, 8A, and 8B.

This embodiment detects, at the time of color balance adjustment, that the printing material 118 has reached the position in FIG. 6C, and switches only the feeding speed of reversal rollers 114 and dual feeding rollers 113 placed on the second feeding path 107 to normal speed. According to the embodiment, a laser beam printer 100 maintains half speed of the respective driving rollers placed on the first feeding path 104 without switching it. This makes it possible to maintain a proper feeding speed in accordance with the thickness of the printing material 118 when an image is to be formed on the second printing material 118.

This embodiment will exemplify a method for feeding the second printing material 118 from the paper feeding unit 117 when image formation on both sides of the first printing material 118 is complete. However, the present invention is not limited to this. That is, while detecting the color balance of each toner patch formed on the first printing material 118, the laser beam printer 100 may form the remaining toner patches on the second printing material 118.

Referring to FIG. 6D, the laser beam printer 100 returns the feeding speed of each driving roller on the second feeding path 107 to half speed when the printing material 118 is fed from the second feeding path 107 to the first feeding path 104 after color balance detection.

Referring to FIG. 8A, the laser beam printer 100 feeds the second printing material 118 from the paper feeding unit 117. Referring to FIG. 8B, the laser beam printer 100 delivers the first printing material 118 to the discharge unit 105, and forms toner patches on the second printing material 118. The laser beam printer 100 then controls the feeding speed of the second printing material 118 in the same manner as the first printing material to feed the second printing material 118 to the second feeding path 107, and detects the color balance of each toner patch.

Upon detecting the color balance of each toner patch on the first and second printing materials 118, the laser beam printer 100 feeds back the detection results to the process conditions, and terminates the color balance adjustment.

Figure 9:
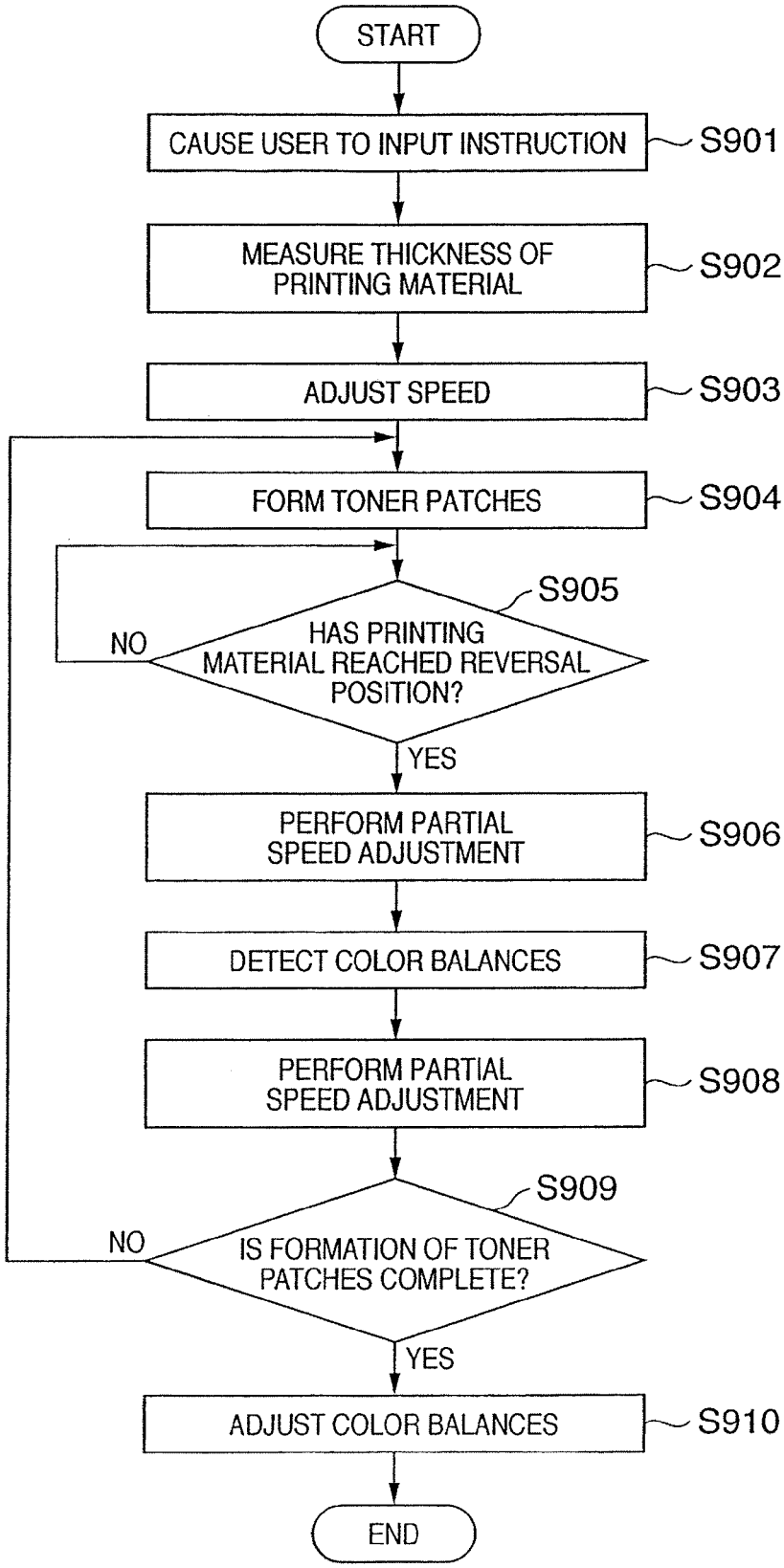
FIG. 9 is a flowchart showing processing in color balance adjustment in the second embodiment.

FIG. 9 is a flowchart showing color balance adjustment processing in the second embodiment. Color balance adjustment using two thick paper sheets as the printing materials 118 will be described below.

A description of technical matters common to those in the description about FIG. 7 will be omitted to avoid redundant description. For example, steps S901 to S904 correspond to steps S701 to S704 described above, and hence a description thereof will be omitted.

In step S905, a feeding speed switching unit 204 determines by using the sheet detection sensor 106 whether the printing material 118 has reached the reversal position. If the result is NO in step S905, the feeding speed switching unit 204 continues detection until the printing material 118 reaches the reversal position. If the printing material 118 has reached the reversal position, the feeding speed switching unit 204 switches the feeding speed of the reversal rollers 114 and dual feeding rollers 113 placed on the second feeding path 107 to normal speed by using a driving motor 207 in step S906. With this operation, the printing material 118 is fed on the second feeding path 107 at normal speed.

In step S907, a color balance detection unit 202 detects the color balance of each toner patch formed on the printing material 118. In step S908, the feeding speed switching unit 204 switches the feeding speed of each driving motor on the second feeding path 107 to half speed.

In step S909, a system control unit 200 determines whether all toner patches are formed. If the result is NO in step S909, the system control unit 200 shifts the process to step S904 to repeat the processing from step S904 to step S908 until all toner patches are formed. If the result is YES in step S909, the system control unit 200 determines that the detection of color balances is complete, and causes the color balance adjusting unit 203 to adjust the color balances in accordance with the detection results.

As described above, the image forming apparatus according to this embodiment may switch the feeding speed on the second feeding path from the first speed to the second speed at least while color balances are detected. This allows the image forming apparatus to speed up color balance detection while maintaining the feeding speed on the first feeding path at a proper feeding speed at the time of image formation. The image forming apparatus can therefore speed up color balance detection without degrading the quality of images formed on the second and subsequent printing materials even if toner patches are formed on a plurality of printing materials.

The first and second feeding paths in the present invention may include sheet detection sensors which detect that a printing material is fed. This allows the feeding speed switching unit to switch the feeding speed only during color balance detection.

In addition, the feeding speed switching unit in the present invention may switch the feeding speed from the second speed to the first speed at the end of color balance detection. This allows the image forming apparatus to form an image even on the back surface of a sheet at a proper feeding speed in double-sided printing operation.

Furthermore, the feeding speed switching unit in the present invention may adjust the feeding speed on the first feeding path in accordance with the type of printing material. This allows the image forming apparatus to form an image at a feeding speed suitable for that type of printing material.

Therefore, the image forming apparatus may switch only the feeding speed of a printing material which is decelerated at the time of image formation, when detecting color balances, without the need to switch the feeding speeds of all types of printing materials. This can therefore simplify the processing.

The present invention comprises a color balance detection unit on, for example, a feeding path different from the feeding path used at the time of image formation. This makes it possible to detect color balances by using a feeding speed higher than that set at the time of image formation. Therefore, the present invention can suppress the prolongation of color balance adjustment even when applying different feeding speeds for different printing materials.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-358162 filed on Dec. 12, 2005, which is hereby incorporated by reference herein in its entirety.

What is claimed is:

1. An image forming apparatus comprising:

a first feeding path for feeding a printing material;

an image forming unit for forming a toner patch on the printing material fed on said first feeding path;

a second feeding path for reversing a front surface and back surface of the printing material fed from said first feeding path and return the reversed printing material to said first feeding path again;

a color balance detection unit placed on said second feeding path and for detecting a color balance of the toner patch formed on the printing material by said image forming unit; and a color balance adjusting unit for adjusting a color balance in said image forming unit based on the detected color balance.

2. The apparatus according to claim 1, further comprising a feeding speed switching unit for switching both a feeding speed on said first feeding path and a feeding speed on said second feeding path from a first speed to a second speed while the color balance is detected.

3. The apparatus according to claim 1, further comprising a feeding speed switching unit for switching a feeding speed on said second feeding path from a first speed to a second speed while the color balance is detected.

4. The apparatus according to claim 2, further comprising sheet detection sensors placed on said first feeding path and said second feeding path and for detecting that the printing material is fed, wherein when said sheet detection sensor detects that the printing material has reached said second feeding path, said feeding speed switching unit switches the feeding speed of the printing material from the first speed to the second speed.

5. The apparatus according to claim 2, wherein said feeding speed switching unit switches the feeding speed on said first feeding path and said second feeding path to the first speed when said color balance detection unit completes detection of the color balance.

6. The apparatus according to claim 2, wherein said feeding speed switching unit switches the feeding speed on said first feeding path in accordance with the type of printing material.

* * * * *